US011001359B2

(12) United States Patent
Kerr et al.

(10) Patent No.: US 11,001,359 B2
(45) Date of Patent: May 11, 2021

(54) ADJUSTABLE HARNESS FOR SAILING AND SAILBOARDING

(71) Applicant: Zhik Pty Ltd., Artarmon (AU)

(72) Inventors: Andrue Kerr, Artarmon (AU); Bartosz Milczarczyk, Artarmon (AU)

(73) Assignee: Zhik Pty Ltd, Artarmon (AU)

( * ) Notice: Subject to any disclaimer, the term of this patent is extended or adjusted under 35 U.S.C. 154(b) by 185 days.

(21) Appl. No.: 16/411,631

(22) Filed: May 14, 2019

(65) Prior Publication Data

US 2019/0351981 A1 Nov. 21, 2019

(30) Foreign Application Priority Data

May 15, 2018 (AU) ..... 2018901692

(51) Int. Cl.
*B63B 35/79* (2006.01)
*B63H 8/54* (2020.01)

(52) U.S. Cl.
CPC ..... *B63H 8/54* (2020.02)

(58) Field of Classification Search
CPC ... B63H 8/50; B63H 8/54; B63H 8/56; B63H 8/58; A62B 35/0018; B63B 32/73
See application file for complete search history.

(56) References Cited

U.S. PATENT DOCUMENTS 4,140,205 A 2/1979 Matson
4,378,614 A 4/1983 McKenney
4,588,044 A 5/1986 Mader
5,069,153 A * 12/1991 Pascher ..... B63H 8/54 114/39.18
7,267,064 B2 * 9/2007 Perale ..... B63H 9/1007 114/39.18
8,894,457 B1 * 11/2014 Crozier ..... B63B 32/70 441/75
9,758,221 B2 * 9/2017 Harrington ..... B63H 8/16

FOREIGN PATENT DOCUMENTS

DE 1984-146830 * 6/1994 ..... B63B 35/79
DE 2015-377025 * 2/2015
FR 2247057 A5 * 5/1975 ..... B63H 9/1007
GB 2 396 654 6/2004
GB 2 443 284 4/2008
GB 2 482 366 9/2015

* cited by examiner

*Primary Examiner* — Andrew Polay
(74) *Attorney, Agent, or Firm* — Nixon & Vanderhye P.C.

(57) ABSTRACT

A harness for sailing, comprising a harness body with a pair of side flaps, a groin piece connected to the harness body and connecting to a spreader bar assembly. The spreader bar assembly comprising a front piece, and a pair of distal flaps, in which a respective side flap can be positioned between the front piece and the respective distal flap to be releasably secured therein; the spreader bar assembly comprising a quick release strap positioned between each distal flap and respective side flap, such that when the quick release strap is moved distally of the spreader bar assembly, the distal flap is separated from the side flap.

20 Claims, 10 Drawing Sheets

ADJUSTABLE HARNESS FOR SAILING AND SAILBOARDING

This application claims priority to AU 2018901692 filed May 15, 2018, the entire contents of each of which is hereby incorporated by reference.

TECHNICAL FIELD

The present invention may relate to a harness support system for trapezing from a sailing vessel, or harness support for a sailboard, or a harness support for a droop hiking position from a sailing vessel. More particularly, the present invention may be related to an improved harness support system with a quick release system.

BACKGROUND

The use of harnesses for watersporting activities is generally well known within the sailing. Conventional trapeze harness support systems have been applied for dinghy sailing and sail boarding applications for some time; however, the harness designs traditionally have consisted of a complex series of strapping adjustments around the legs and waist or a custom fit design without enough adjustment and support. Strapping adjustments provide a series of linear tensioning points rather than uniform load support.

Further, the comfort of a harness may be compromised for support which may make the user safer, however the overall user experience is diminished or negatively impacted as the harness is not enjoyable to use.

Known harnesses include spreader bars and hooks such as those discussed in U.S. Pat. No. 4,588,044. Further, there are a number of known release systems for safety such as those discussed in U.S. Pat. Nos. 4,140,205, 4,378,614 and GB 2,396,654.

Other known harnesses comprise an adjustable double hook and loop fastening system that connects a front spreader bar assembly to the body of the harness. GB2443284A discloses the use of stretchable materials in the groin to improve comfort to the wearer. GB2482366B is another known system with a multi-layered stretchable groin area that provides and gradual increase in stretch from the non-stretch body of the harness and spreader assembly to stretchable groin area thereby reducing load on the joins between each panel and improving strength and durability of the harness.

However, none of the known prior art allow for a spreader bar piece to be interchanged without significant deconstruction of a harness. This presents a significant disadvantage as strapping systems are generally required to connect to the spreader bar. The difficulty in interchanging spreader bars often results in the harness being disposed of when a spreader bar is damaged. Further, as spreader bars are frequently damaged during use this is a problem. Further, many users have different personal preferences in the design of the spreader bar, acquiring a harness with a desired spreader bar may be difficult.

Other problems associated with known harnesses include ease of use, comfort issues (particularly near to the groin of a wearer), access to harness components of the harness and longevity of the harness. As such, there are a number of problems with the known harnesses.

Any discussion of the prior art throughout the specification should in no way be considered as an admission that such prior art is widely known or forms part of common general knowledge in the field.

SUMMARY

Problems to be Solved

It may be advantageous to provide for a harness with improved comfort for a wearer.

It may be advantageous to provide for a harness which allows for replacement of a spreader bar.

It may be advantageous to provide for a support device, such as a harness, which allows for replacement of structural supports within the device.

It may be advantageous to provide for a device with a quickly release system.

It may be advantageous to provide for a device which provides for easier mounting and dismounting.

It may be advantageous to provide for a support device which provides for an easier system for donning and doffing said device.

It is an object of the present invention to overcome or ameliorate at least one of the disadvantages of the prior art, or to provide a useful alternative.

Means for Solving the Problem

In a first aspect there may be provided a harness for sailing. The harness comprising a harness body with a pair of side flaps. A groin piece connected to the harness body and connecting to a spreader bar assembly. The spreader bar assembly comprising a front piece, and a pair of distal flaps, in which a respective side flap can be positioned between the front piece and the respective distal flap to be releasably secured therein; and wherein the spreader bar assembly comprises a quick release strap positioned between each distal flap and respective side flap, such that when the quick release strap is moved distally of the spreader bar assembly, the distal flap is separated from the side flap.

Preferably, moving the release strap further distally may separate the side flap from the spreader bar assembly. Preferably, the harness body may further comprise a pair of straps. Preferably, the spreader bar assembly may comprise a pocket in which a spreader bar is housed. Preferably, a hook may project distally of the spreader bar assembly. Preferably, the front piece, side flaps and distal flaps may comprise hook and loop fasteners. Preferably, the release straps may be fixed to the side flaps at a periphery. Preferably, the groin piece may be formed with a graduated elasticity. Preferably, the harness body comprises a pad which may be positioned in a lower region of the harness. Preferably, the quick release strap may comprise a toggle at a free end.

In another aspect, there may be provided a harness for sailing. The harness comprising a harness body having a pair of shoulder straps and a groin portion, the groin portion being fixed to a spreader bar assembly, the spreader bar assembly comprising a pocket formed from a front piece and a rear covering panel, the pocket being adapted to receive a spreader bar with a hook, in which the hook is adapted to be mounted through an aperture formed in the front piece, and wherein the spreader bar comprises an attachment point such that a shoulder strap can be mounted to the attachment point within the pocket, and an opening is formed at the top of the pocket to pass the shoulder strap into the pocket.

Preferably, the harness body may comprise a pair of side flaps. Preferably, a pair of distal flaps may be mounted on the front piece of the spreader bar assembly. Preferably, a release strap may be connected to the front piece. Preferably, a release strap may be connected to the side flaps. Preferably, the groin portion may have a graduated elasticity. Preferably, the rear covering panel comprises a pad. Preferably, the harness body may comprise a reinforcing means. Preferably, the spreader bar may be removable from the pocket. Preferably, the harness body may further comprise a back portion with a pad positioned about a lumbar region of a wearer when in use.

In the context of the present invention, the words "comprise", "comprising" and the like are to be construed in their inclusive, as opposed to their exclusive, sense, that is in the sense of "including, but not limited to".

The invention is to be interpreted with reference to the at least one of the technical problems described or affiliated with the background art. The present aims to solve or ameliorate at least one of the technical problems and this may result in one or more advantageous effects as defined by this specification and described in detail with reference to the preferred embodiments of the present invention.

DESCRIPTION OF THE INVENTION

Figure 1:
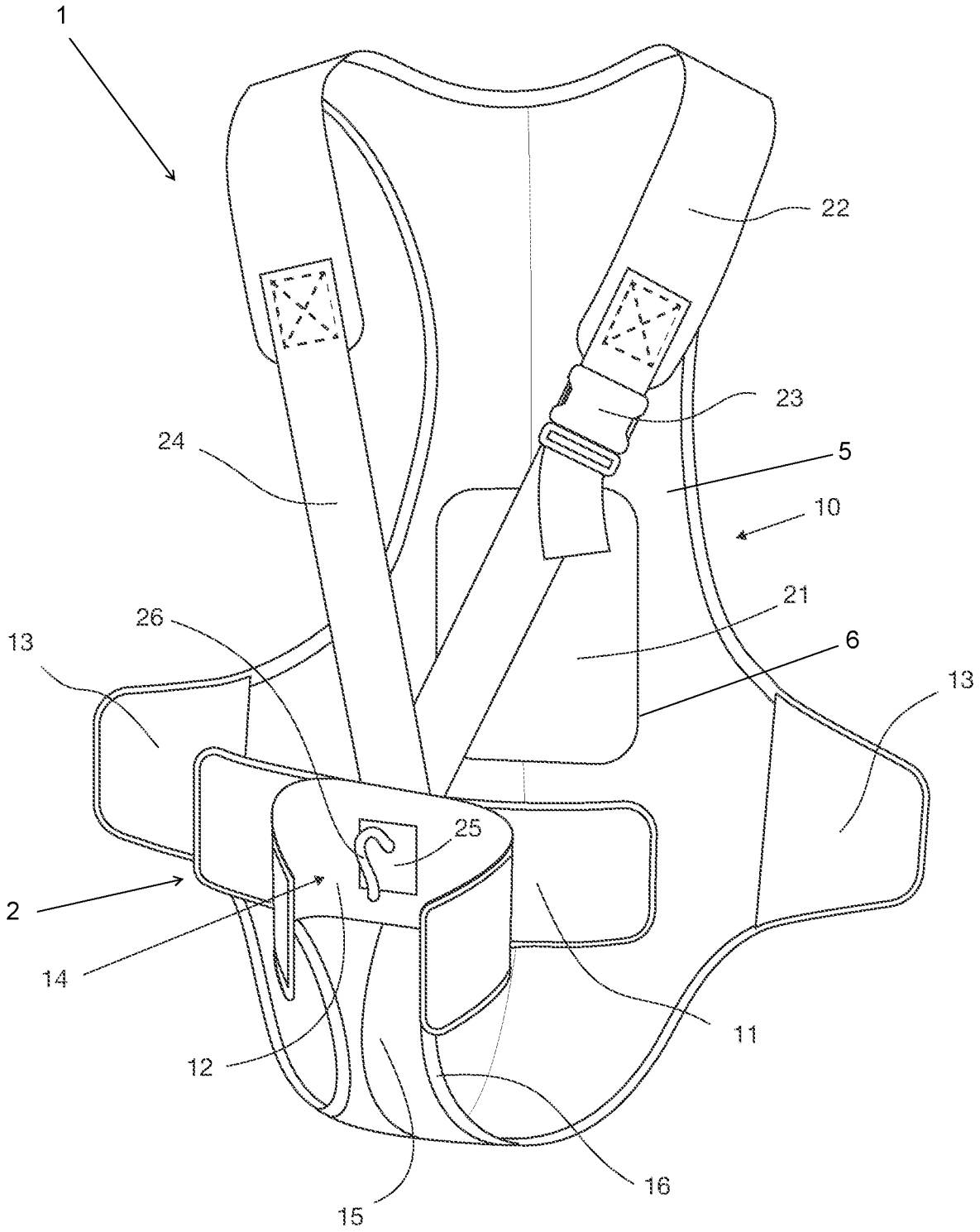
FIG. 1 illustrates a front view of an embodiment of a trapeze harness with open side flaps.

Preferred embodiments of the invention will now be described with reference to the accompanying drawings and non-limiting examples.

DICTIONARY

1 Harness
2 Fastening system
3 Quick release system
5 Back portion
10 Harness body
11 Front piece
12 Distal flap
13 Side flap
14 Spreader bar assembly
15 Groin piece
21 Pad
22 Shoulder strap
24 Strap
25 Spreader bar
26 Hook
27 Attachment point
29 Projection tab
30 Release strap
31 Front piece mating means
32 Distal flap mating means
33 Distal side flap mating means
34 Proximal side flap mating means
35 Strap mating means
70 Pocket
71 Hook aperture
72 Covering panel
74 Opening
76 Access hole
80 Locating block
81 Fastening attachments In one embodiment, there is provided an improved harness 1 with an adjustable fastening system 2 having a quick release system 3 and a spreader bar assembly 14. The assembly 14 preferably comprises an interchangeable spreader bar 25. The harness 1 may provide a superior fit for a user while also improving the ease of use of a harness 1. Further, the harness 1 may provide for additional support typically in the lower lumbar region, near to the groin area and/or near to the assembly 14.

FIG. 1 illustrates an embodiment of a harness 1 with a harness body 10, a spreader bar assembly 14, a fastening system 2 which may be used to secure the harness 1 about the waist or hips of a user, and a pair of straps 22 to mount over the shoulders of a user.

The harness body 10 comprises a back portion 5 which is adapted to support the back of a user when in use. The back portion 5 comprises at least support member and/or at least one pocket 6 which can house pad 21 or may house a support element to protect the user of the harness 1 from abrasion and/or impacts. The pad 21 may be positioned in the general lower lumbar region of the user such that the user is less likely to feel fatigue or soreness from use of the harness 1. Further, the support element may assist with improving the posture of the user during use. Other padding may be provided in the back portion 5 of the harness 1. A reinforcing means 16 may be provided at the perimeter of the back portion 5, which assists with wear and tear of the back portion 5 and reducing the stretching of the harness 1 undesirably. The reinforcing may also assist with keeping layers of the harness sewn together. Other reinforcing means may be provided in the body 10 to improve the support of the harness 1 and may improve the wearability of the harness 1. The back portion 5 may also be formed with a breathable liner or formed with a breathable textile which may improve heat regulation and air flow at the back of a user of the harness 1. Improves breathability may also increase the comfort of the user when wearing the harness 1.

A pair of shoulder straps 22 extend from the back portion 5 and are connected to a adjustment strap 24 which is used to adjust the relative portion of the shoulder straps 22 when in use. The adjustment strap 24 may be formed from a material is a low elasticity, such as nylon, polyester or any other suitable material which may be exposed to water and/or UV radiation and maintain integrity of the adjustment strap 24. The adjustment strap 24 may be fixed to attachment locations on the shoulder straps 22. The adjustment strap 24 may comprise two portions, and a buckle 23 connects the two portions together. This has the benefit of allowing the adjustment strap 24 can be disconnected allowing easier donning and doffing the harness 1, and may also allow for the adjustment strap 24 to be connected to a spreader bar 25 attachment point 27.

The spreader bar 25 forms a portion of the spreader bar assembly 14. The spreader bar assembly 14 is connected to groin piece 15, and may also be connected to adjustment strap 24 in use. The spreader bar assembly 14 may form a portion of the fastening system 2.

The fastening system 2 is preferably fitted with a quick release system 3, which may be used to adjust the fit around the waist of a wearer. The system 2 comprises a spreader bar assembly 14 housed in pocket 70. The front piece 11 forms the distal wall of the pocket 70. The proximal end 2' of the spreader bar assembly 14 is the end which is closest to a wearer when in use, and the distal end 2" is the end furthest from the user. A spreader bar 25 is housed in the pocket 70 of the spreader bar assembly 14. The spreader bar 25 may be any predetermined sailing or trapeze spreader bar 25 with a hook 26. A hook aperture 71 is provided in the front piece 11 which allows for the hook 26 or other trapeze attachment means 26 to be passed therethrough.

The harness body 10 includes two side flaps 13 extending from respective sides the back portion 5 (as seen in FIG. 1) around towards the spreader bar assembly 14. Each side flap comprises a hook and loop fastening system for the connection to the spreader bar assembly 14 with the side flaps 13. Optionally, the side flaps 13 may have a double hook and loop fastening system.

The fastening system 2 makes it possible to provide a wider range of custom adjustable positions for the body of the user, and may allow for a number of different body types to effectively and comfortably use the harness 1. Notably, the fastening system 2 allows the harness 1 to fit better and become more responsive to body movement while sailing, while also providing improved muscular support, comfort, dexterity and responsiveness to the dynamics of the boat or sailboard. The structure of the fastening system 2 may be adjusted for comfort by the user.

The fastening system 2 comprises side flaps 13, spreader bar assembly, and distal flap 12. The spreader bar assembly 14 has a front piece 11 formed with a mating means 31 to which the side flaps 13 can be secured to. A mating means is provided on side flap 13 which mates with a corresponding mating means of the front portion 11. In this configuration the distal side 2" of the front piece mates with a proximal side of the side flaps 13. The distal flap 12 may then be secured to cover at least a portion of the distal side of the side flaps 13. Again, the side flaps 13 may comprise a securing means and the distal flap 12 comprises a mating securing means which is adapted to mate with the distal side mating means 33 of the side flaps 13.

A middle portion of the distal flap 12 may be fixed to the spreader bar assembly 14. The distal flap 12 may also be formed with an aperture to allow for the hook 26 of the spreader bar 25 to be passed therethrough. In another embodiment, the distal flap 12 is fixed onto the front piece 11 in two discrete portions rather than a middle piece of a unitary distal flap structure. Fixing the distal flap 12 may be achieved by at least one of; sewing, stitching, gluing, adhering or using any other suitable attachment method.

The configuration of the spreader bar assembly 14, side flaps 13 and the front flap 12 when the fastening system 2 is in a close configuration is such that the side flaps 13 are distal the spreader bar assembly 14, and the distal flap 12 is distal the side flaps 13. The mating 31, 32, 33, 34 means restricts the withdrawal of the side flaps 13 from between the distal flap 12 and the front portion 11 when in use.

Any of the mating means may be hook and loop fasteners, buttons, press studs, buckles, connectors, ties, or other corresponding mating means may be used to secure the side flaps 13 to at least one of the front piece 11 and the distal flaps 12.

In another embodiment, a quick release system 3 is provided on the fastening system 2. The quick release system 3 comprises one or more release straps 30 that facilitate disengagement of the fastening system 2 fasteners that connect the front piece 11, distal flaps 12 and side flaps 13 by separating the mating means of these features. For example, if the mating means may be hook and loop fasteners, the release strap 30 can be used to lift a distal flap 12 relative to its respective side flap 13. Lifting the adjoining hook and loop surfaces away from each other in a single motion may facilitate a quick release.

In one embodiment, the release strap 30 is attached to a side flap 13, with each side flap 13 preferably comprising a respective release strap 30. A release strap 30 may be fixed to the periphery of the side flap 13, as seen in FIGS. 3B and 3C. In another embodiment the release strap is connected to the proximal side of the side flap 13 and extend between the front piece 11 and the proximal side of the side flap 13, as seen in FIG. 5C. It will be appreciated that a single release strap may be used to separate flaps 13, 12 on only one side of the assembly 14. Other release strap configurations may also be provided which allow for separation of the distal flap 12 from the side flaps 13.

The release strap 30 may be between 1 mm to 20 mm in thickness or diameter. The release strap may be formed from nylon, polyester, PET, rubber, synthetic webbing, or any other durable material which may allow a tension to be imparted to the release strap 30 for releasing the flaps 12, 13 and/or the front piece 11 from each other. Optionally, the release strap 30 may also be fitted with a securing means or mating means 35, such as hook and loop fasteners, which allows for improved mating of the fastening means 2 as the strap 30 allows adjacent flaps 12, 13 to be mated with the strap rather than being a point of non-connection.

If the release strap 30 is connected at the periphery, the strap 30 may be connected to the seam or may be fixed in between the layers of textile used to form the side flaps 13. Alternatively, the strap 30 is secured to the outer surface of the side flap 13. The free end of the release strap 30 may comprise a gripping means which assists with a user gripping the free end to allow the release of the assembly 14. The gripping means may be any suitable means which allows for improving the grip of a user such as; a toggle, non-slip coating, sewn loop, or any other gripping means.

To use the release strap 30, the free end of the release strap 30 can be gripped by a wearer and the strap pulled towards the hook location in the middle of the spreader bar assembly 14. As the strap 30 is pulled towards the middle, the distal flap 12 is lifted or otherwise separated from the side flaps 13. To release the side flap 13 from the front piece 11, the release strap may then be pulled away from the hook by pulling the straps in an opposing direction than to release the distal flaps 12.

Figure 2:
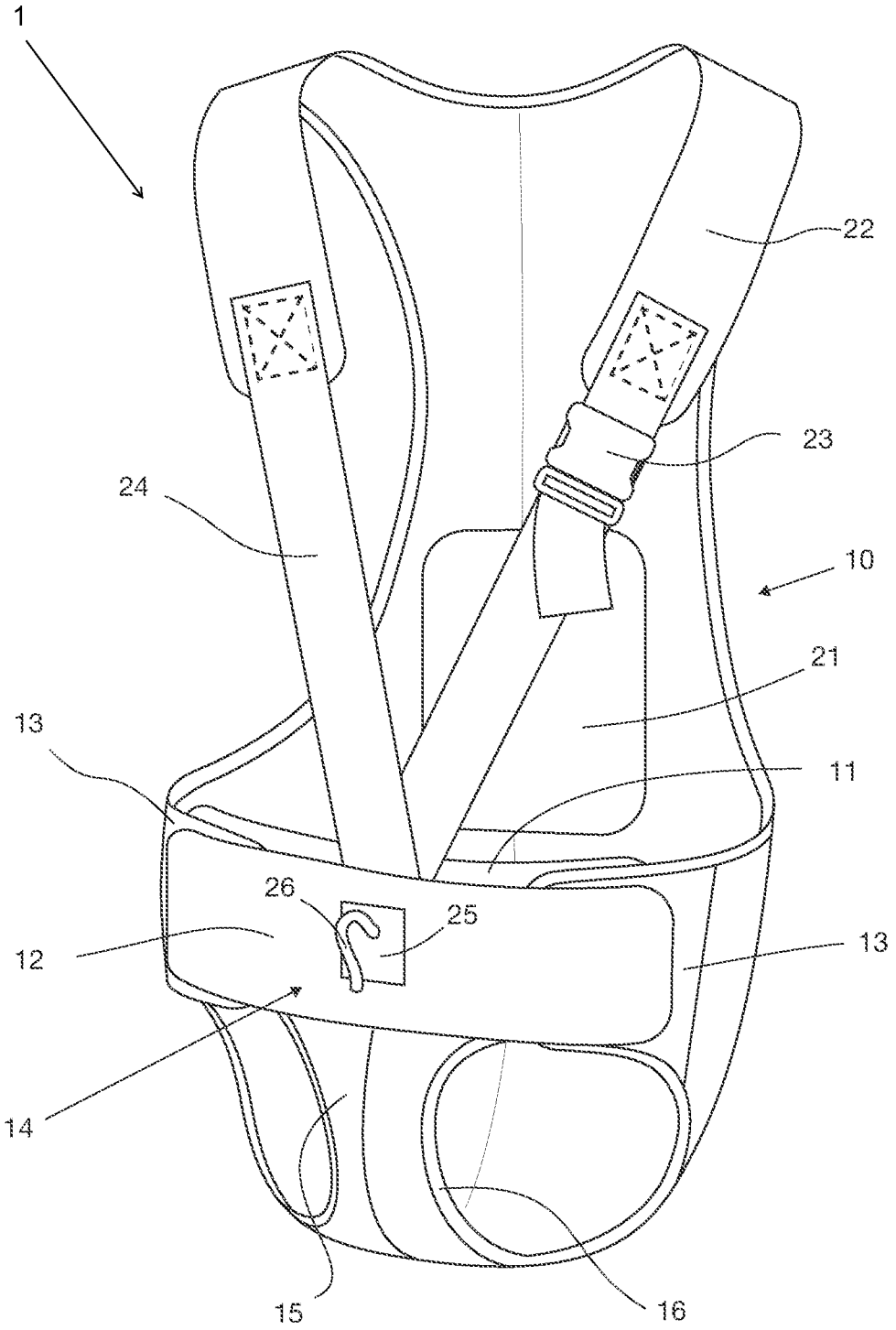
FIG. 2 illustrates a front view of an embodiment of a trapeze harness with closed side flaps.

FIG. 1 shows the harness 1 in an open configuration and FIG. 2 shows the harness in a closed configuration. The release straps 30 may allow for opening or release of the fastening system 2 of the harness 1.

Figure 3A:
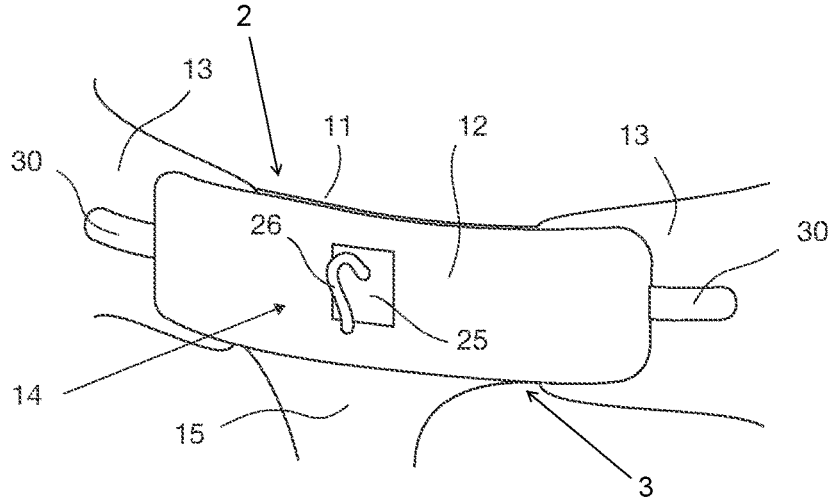
FIG. 3A illustrates an embodiment of a quick release strap assembly in a closed configuration.
Figure 3B:
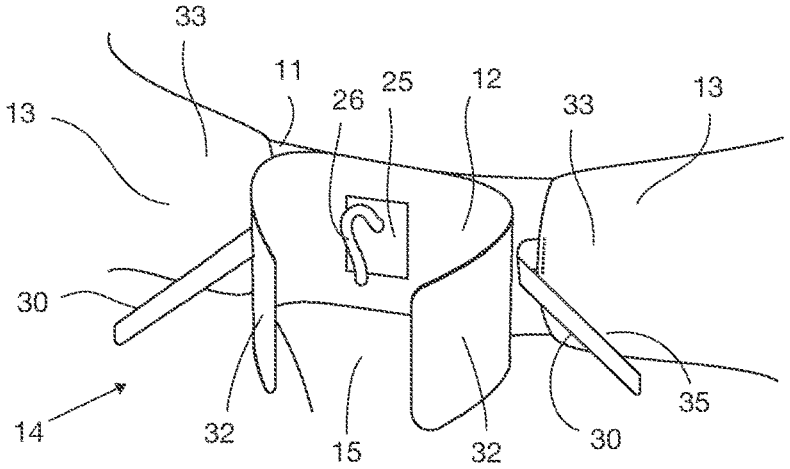
FIG. 3B illustrates an embodiment of the quick release strap assembly of FIG. 3A, in which the assembly is shown part-way through a quick release action.
Figure 3C:
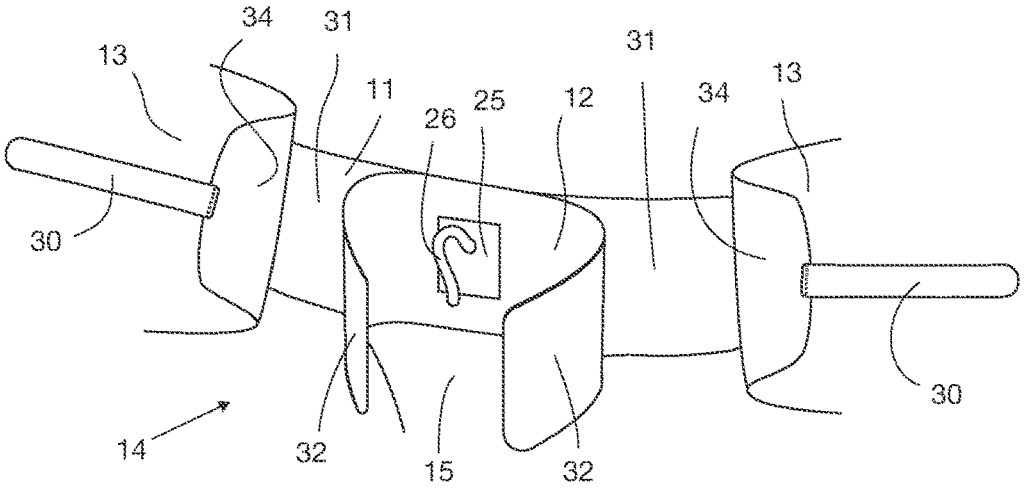
FIG. 3C illustrates an embodiment of the quick release strap assembly of FIG. 3A, in which the assembly is shown in an open configuration at the end of a release action.

FIGS. 3A to 3C illustrate an embodiment of a spreader bar assembly 14 fitted with a quick release system 3 which is moved from a secured position (closed configuration) to a released position (open configuration). The spreader bar assembly 14 allows for securing of the harness to a user and to a sailing vessel. In this embodiment, the release straps 30 are fixed to the periphery of the side flaps 13 (see FIG. 3B for example). As seen in FIG. 3A, the assembly 14 is in a secured or closed configuration with two release straps 30 which may be gripped for a user to manipulate to effect the quick release of the harness 1. The portion of the straps 30 which are gripped in the closed configuration may be referred to as a free end of the strap 30. The open configuration is illustrated in FIG. 3C wherein the flaps 12, 13 and front piece 11 are not connected to each other.

Figure 4A:
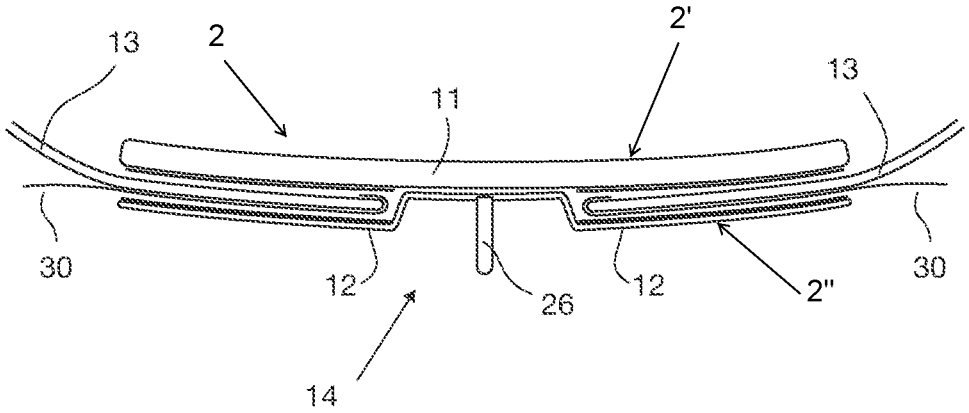
FIG. 4A illustrates a top view of the embodiment of the quick release strap assembly as shown in FIG. 3A.
Figure 4B:
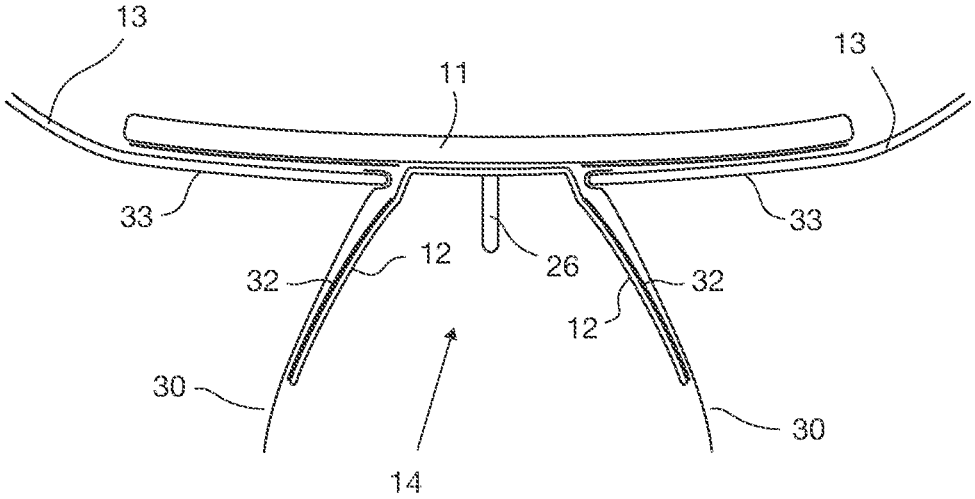
FIG. 4B illustrates a top view of the embodiment of the quick release strap assembly as shown in FIG. 3B part-way through a quick release action.
Figure 4C:
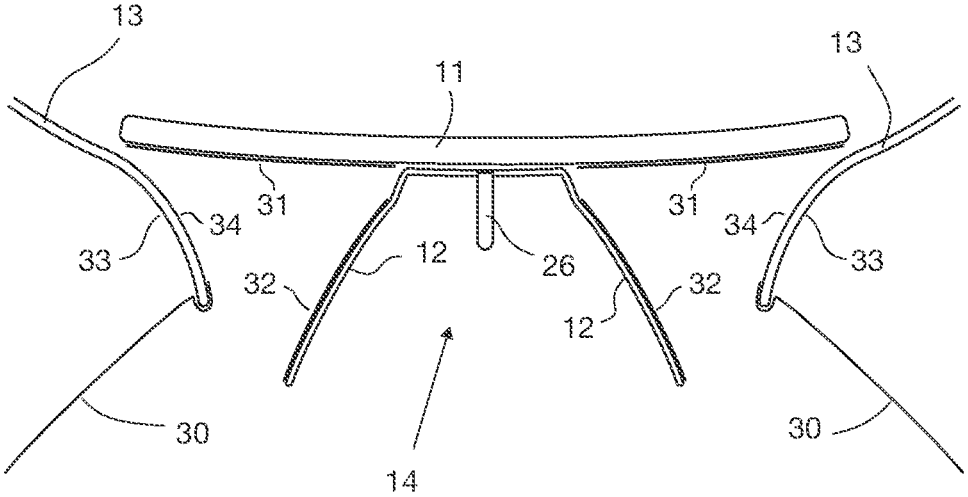
FIG. 4C illustrates a top view of the embodiment of the quick release strap assembly as shown in FIG. 3C, in which the assembly is in an open configuration at the end of a release action.

FIG. 4A to 4C illustrates a top view of the spreader bar assembly 14 transitioning from a closed configuration to an open configuration (or released configuration). Similar to FIGS. 3A to 3C, the release straps 30 are positioned at the periphery of respective side flaps 13. As can be seen, the distal flaps 12 and the side flaps 13 may be flexible to allow mating of the assembly 14 flaps and the front piece 11. The strap 30 is preferably formed with a relative thickness less than that of side flap 13. Optionally, a release strap mating means 35 may be provided on the strap 30 to secure the free end of the strap to the side flap 13 such that the free end is not inadvertently pulled or manipulated by a user.

Figure 5A:
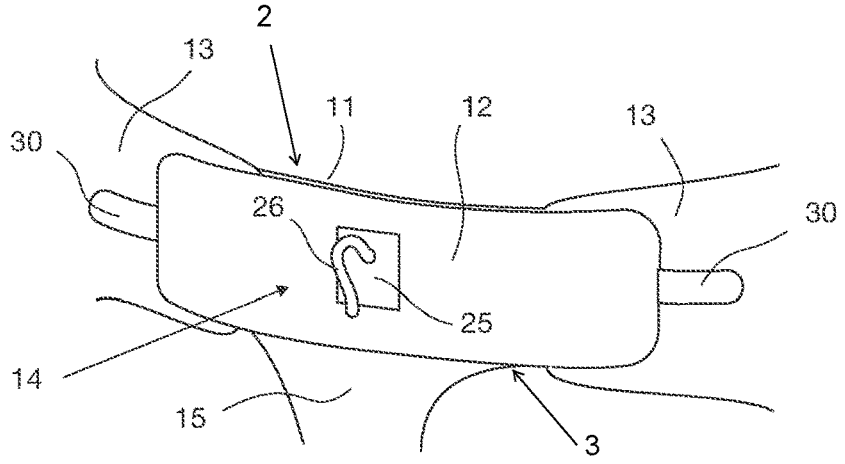
FIG. 5A illustrates a perspective view of another embodiment of a quick release system in a closed configuration.
Figure 5B:
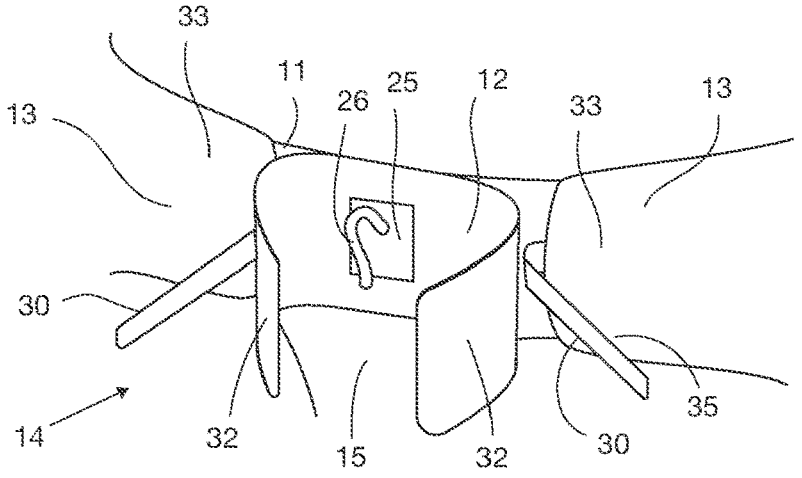
FIG. 5B illustrates a perspective view of another embodiment of a quick release system part way through a release process.
Figure 5C:
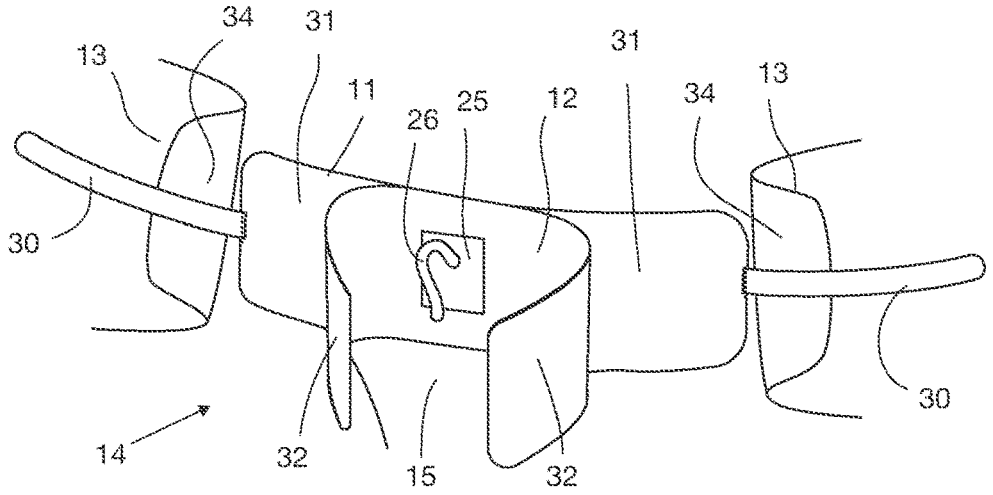
FIG. 5C illustrates a perspective view of another embodiment of a quick release system in a release or open configuration.
Figure 6A:
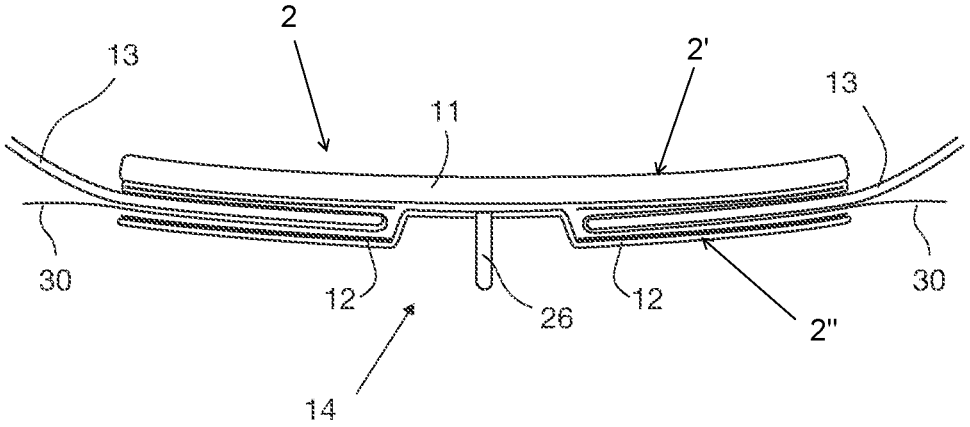
FIG. 6A illustrates a top view of the embodiment FIG. 5A.

FIGS. 5A to 5C illustrates another embodiment of a spreader bar system 14 with a quick release system 3. In this embodiment the spreader bar assembly 14 comprises release straps which are fixed to the front piece 11 rather than the side flaps 13. This may allow for the release straps 30 to be positioned between the front piece 11, the side flap 13 and extend around to the distal side of the side flap 13 to between the distal flap and the side flap 13 as seen in FIG. 6A. The side flap 13 comprises a distal side flap mating means 33 (first mating surface) which is adapted to mate with a corresponding mating surface 32 (distal flap mating means 32) of the distal flap 13. The side flap 13 further comprises a proximal side flap mating means 34 (second mating surface) which can mate with a corresponding mating surface 31 (front piece mating means 31) of the front piece 11. Each of the mating surfaces 31, 32, 33, 34 may be hook and loop surfaces which can form a mating relationship to secure the mating surfaces together. The mating surfaces may be integrally formed with at least one of the side flap 13, front piece 11 and the distal flap 12.

Figure 6B:
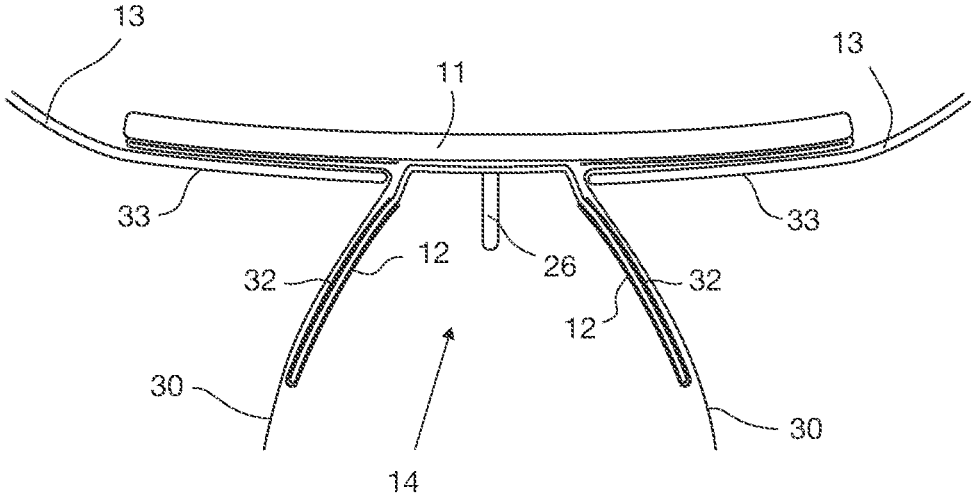
FIG. 6B illustrates a top view of the embodiment of FIG. 5B.
Figure 6C:
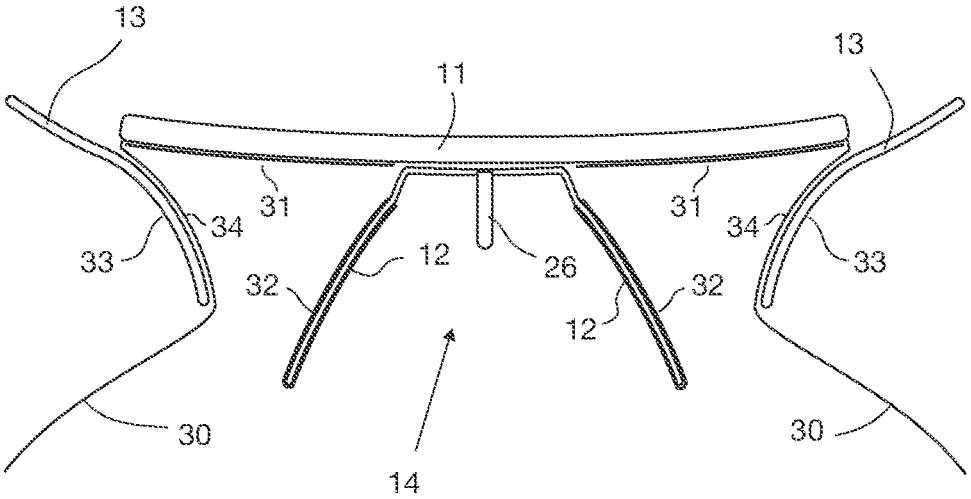
FIG. 6C illustrates a top view of the embodiment of FIG. 5C.

Referring to FIGS. 6A to 6C show a top view of the embodiment of FIGS. 5A to 5C, respectively. More particularly, there is shown an embodiment of a release method in which the release system 3 comprises a release strap 30 which is attached to a periphery of the front piece 11. In this way the release strap 30 extends along both sides of a side flap 13 between the mating surfaces between the distal flap 12 and the side flap 13, and also the side flap 13 and the front piece 11.

FIG. 6A shows the spreader bar assembly 14 in a closed configuration. To separate the distal flap 12 the release strap 30 is moved distally or towards the hook 26 as shown in FIG. 6B. Moving the release strap 30 in this direction lifts a distal flap 12 from the mating relationship with the side flap 13. Once the distal flap 12 is unmated with the side flap 13, the side flap may be unmated from the front piece 11 by further pulling the release strap 30 distally, or moving the release strap in a direction away from the hook 26. This results in the configuration as seen in FIG. 6C in which the assembly 14 is in released configuration.

The harness 1 comprises spreader bar assembly 14 which houses a spreader bar 25. The spreader bar 25 may be removed from the assembly 14 and interchanged by the user to allow for repair and/or use of different configurations of spreader bar to suit requirements. Preferably, the spreader bar 25 is mounted in the pocket 70 such that the spreader bar 25 is releasably retained in a desired position, such that the hook 26 protrudes distally of the front piece 11 of the spreader bar assembly 14. The spreader bar 25 may be mounted and secured in the pocket 70 by means of hook and loop fastening means 75, 81 (see FIGS. 7A and 8A for example). Alternatively, press studs or other fastening means known in the art may also be used to secure the spreader bar 25 in the pocket 70.

The front piece 11 may form the distal wall of the pocket 70, and a rear covering panel 72 may be used to form the pocket 70. A zipper (zip), hook and loop fastener, or any other suitable securing means may be provided to enclose or secure the spreader bar 25 between the front piece 11 and the rear covering panel 72. In this way, the spreader bar 25 is positioned distal the rear covering panel 72 and proximal the front piece 11, with the hook 26 of the spreader bar 25 projecting distally of the front piece 11 when in use. The securing means can be released or opened to form an opening to allow insertion and removal of the spreader bar 25 into the pocket 70. The spreader bar 25 is formed with a rigid frame such that loads can be spread via the harness 1 during the acts of hiking or trapezing with the harness 1. The spreader bar 25 is preferably positioned within or connected to the front piece 11. Optionally, the spreader bar 25 preferably has a covering on the inside of the pocket 70 such that the body of the user is insulated from direct contact with the spreader bar 25. The covering in the pocket 70 may be a closed cell foam layer, a cushion, or any other deformable impact material suitable for use in water. A similar material may be used for the pad 21 in the back portion 5 of the harness 1.

The spreader bar assembly 14 is connected to groin piece 15 which extends from the back portion 5. Groin piece 15 can be positioned between the legs of a user when in use and may be formed with a flexible and/or elastic material. Preferably, the groin piece 15 is formed with material which allows for a graduated elasticity. The graduated elasticity may be formed by a plurality of layers of elastic textile, such as neoprene, which are fixed together in varying thickness or a varying number of layers to allow more stretch (elasticity) in some regions of the groin area 15. Preferably, the highest level of elasticity is near to, or at, the region where the genitalia of a user is likely to be positioned when in use. This may provide an improved level of comfort for the user when in use and also allow for improved movement which wearing the harness 1.

Figure 7A:
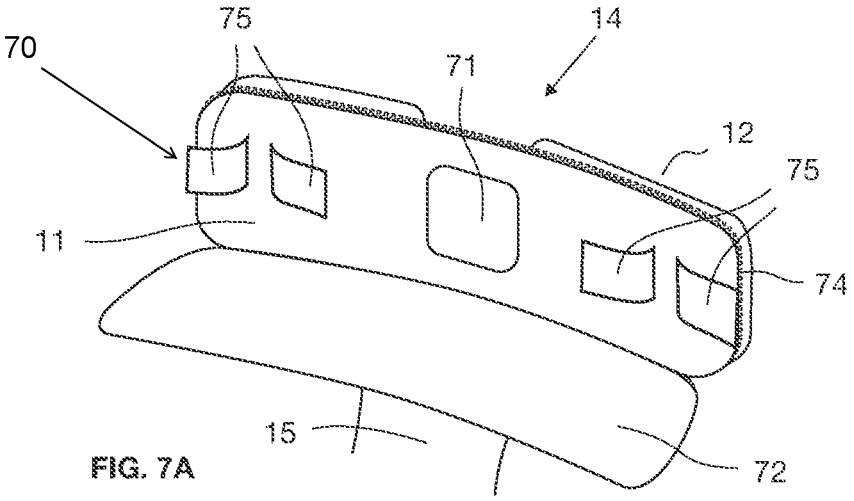
FIGS. 7A to 7C illustrate an embodiment of a process for mounting of a spreader bar in the pocket of the assembly.
Figure 7B:
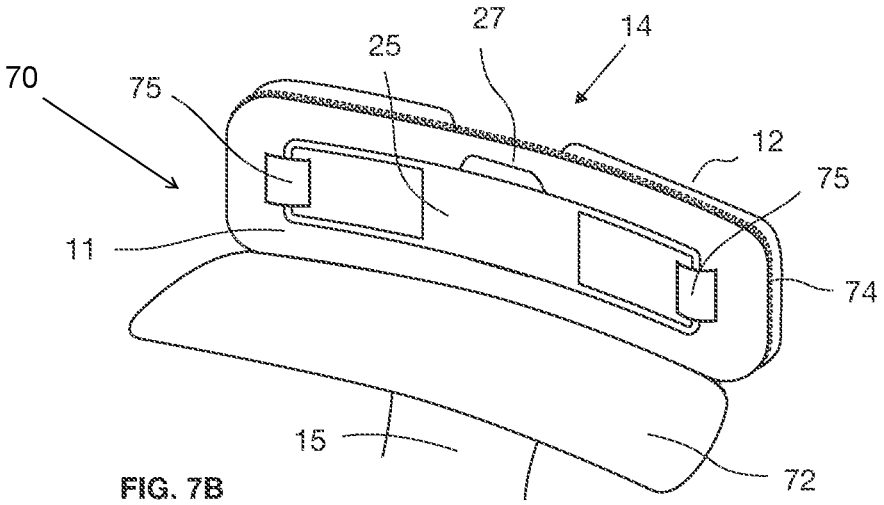
Figure 7C:
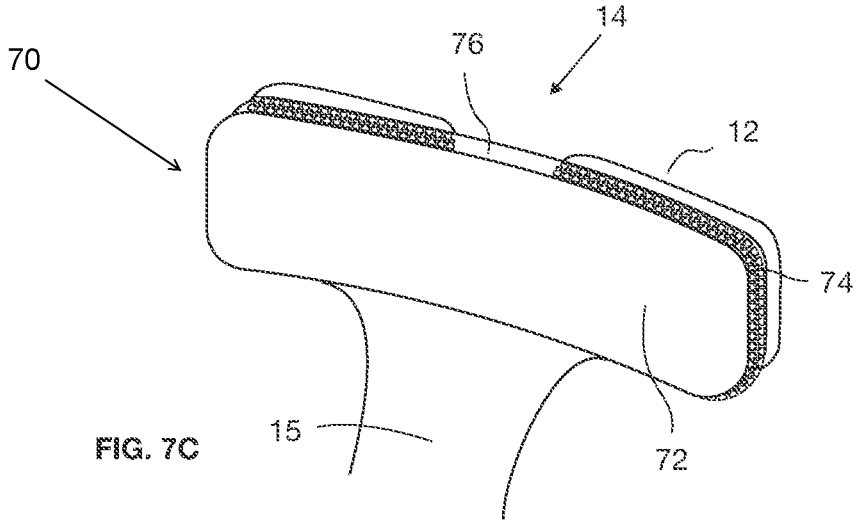

Referring to FIGS. 7A to 7C, the spreader bar assembly 14 comprises a front piece 11 and distal flap 12, each with a respective hook and/or loop fastening system which can be mated with side flaps 13 with a corresponding hook and/or loop fastening system. A removeable and interchangeable spreader bar 25 is mounted in pocket 70, with the hook of the spreader bar protruding through an aperture 71 of the front piece 11. The spreader bar 25 may be attached to the front piece 11 by one or more fastening attachments 75 which are fixed to the inside of the pocket 70. Several fastening attachments may be provided in various locations for fitment of different sizes and shapes of spreader bars. Fastening attachments 75 may be comprised of hook and loop fasteners, press studs or any other fastening means. An optional rear covering panel 72 covers the spreader bar 25 and forms a proximal wall for the pocket 70. The rear covering panel 72 can be fixed to front piece 11 by means of a zip 74 or other securing means, and access to the spreader bar 25 may be provided by means of an opening 74. The opening may be defined by a zipper, hook and loop fastener or other fastening means. Preferably, the panel 72 is formed with or comprises a pad (not shown) positioned between the spreader bar 25 and the user to prevent or reduce discomfort caused by the rigid spreader bar being pressed against the wearer of the harness 1 when in use. The pad may be formed from a closed cell foam such as neoprene or EVA foam between 2 mm to 5 mm thickness. Similarly, the pad 21 may also be formed from a similar material with a thickness of 2 mm to 10 mm, although any desired thickness may be used. The spreader bar assembly 14 also features a shoulder strap attachment point 27 which is preferably provided at the centre top of the spreader bar 25 but may also be fixed to the front piece and/or over flap 12. If the shoulder strap attachment point 27 is provided on the spreader bar 25, a strap aperture 76 may be formed at the top of the pocket (between front piece 11 and rear covering panel 72) such that the shoulder adjustment strap 24 may be passed into the pocket to loop around the attachment point 27 and then return to the other shoulder strap. An example of a strap aperture 76 is shown in FIG. 7C.

Figure 8A:
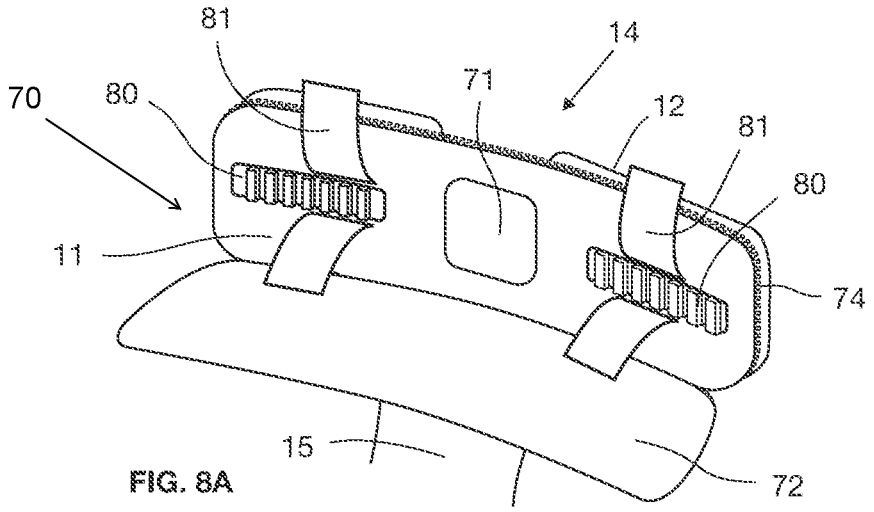
FIGS. 8A to 8C e an embodiment of a process for mounting of a spreader bar in the pocket of the assembly.
Figure 8B:
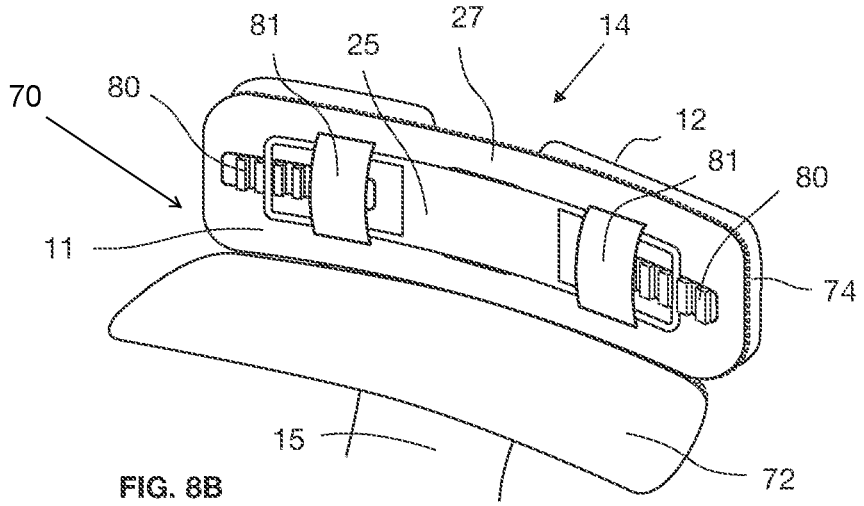
Figure 8C:
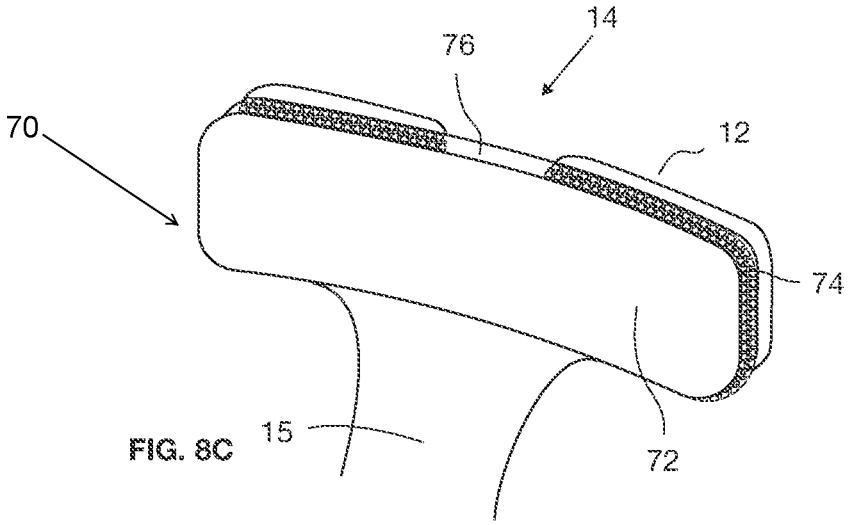

FIGS. 8A to 8C illustrate an embodiment of a system for retaining a spreader bar 25. The spreader bar 25 can be mounted in a locating block 80. The locating block 80 used to releasably retain the spreader bar 25. The locating block 80 comprises a plurality of teeth or protrusions which can be used to retain a portion of the spreader bar frame. The frame may be urged to between two or more protrusions of a block 80 and the protrusions may form an abutting relationship with the frame to hold the frame therein (see for example, FIG. 8B). The blocks 80 can be formed from a flexible polymer, a foam, or a metal and allows for enough flexure such that a spreader bar frame can be received and removed a plurality of times. The protrusions of the blocks 80 may also be cut to shape and portions of the protrusions may have cut away sections to allow for accommodation of the spreader bar. In this way, the protrusions may be similar in function to C-clips or tubing mounting clips. The extremities of the protrusions may also be formed with a bulbous end such that the frame of the spreader bar 25 can be retained between the protrusions.

A further fastening means 81 may also be provided to secure the spreader bar 25 in a desired position. The further fastening means may be a pair of elongate straps which are fitted with corresponding hook and loop fasteners or are fitter with another securing means. The pair of elongate straps may be used to loop around a portion of the spreader bar and the corresponding securing means can be mated. An example elongate straps is shown in FIGS. 7A, 7B, 8A and 8B. Preferably a plurality of further fastening means 81 can be disposed within the pocket 70. The further fastening means 81 may be used to reduce or prevent lateral, transverse and forward and backwards movement of the spreader bar in use which may assist with improving comfort of the user.

Figure 9:
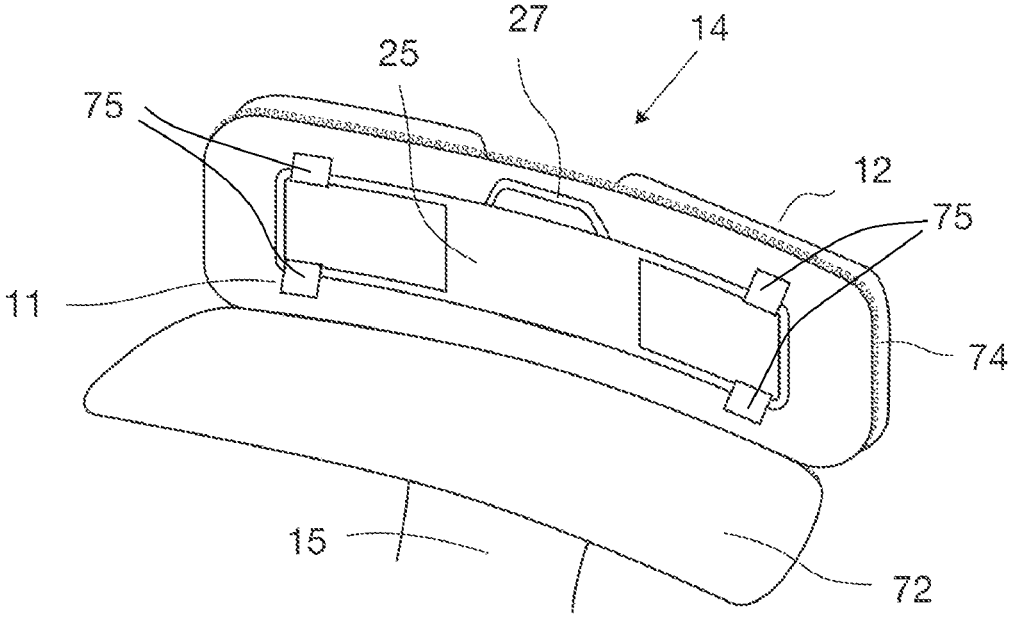
FIG. 9 illustrates another embodiment of a securing means for a spreader bar within the pocket of the assembly.

FIG. 9 shows an embodiment of an embodiment of a securing means which is disposed within the pocket 70. The securing means may be loop fasteners which are secured with the use of hook and loop fasteners. The securing means are used to retain the spreader bar within a desired location in the pocket 70.

Figure 10:
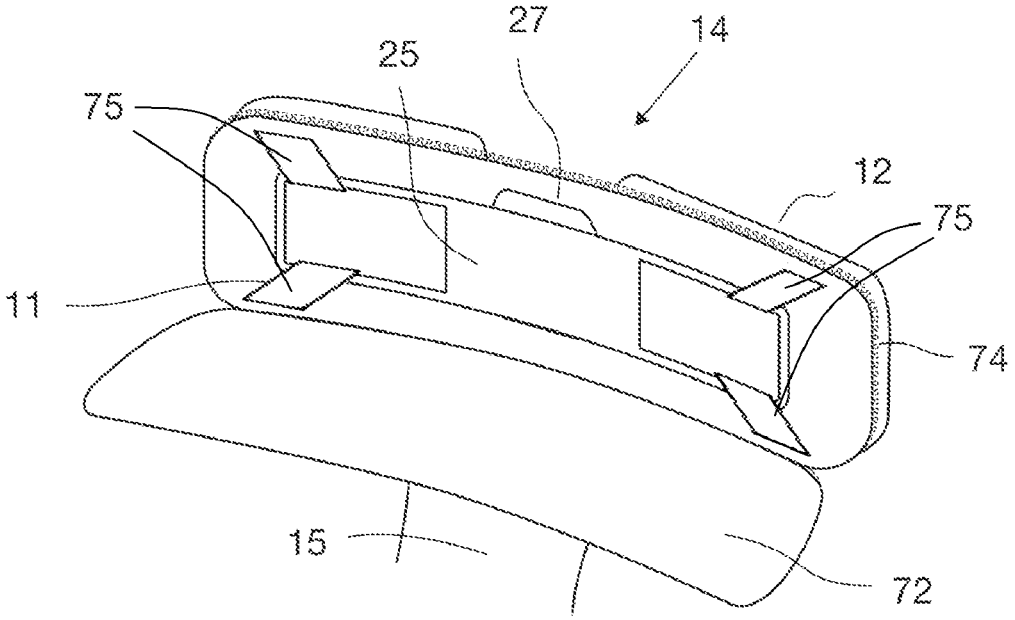
FIG. 10 illustrates a further embodiment of a securing means for a spreader bar within the pocket of the assembly.

FIG. 10 illustrates yet another embodiment of a securing means within the pocket 70. In this embodiment loops may be used to secure the spreader bar at the corners of the spreader bar. The loops may be disposed diagonally and are mountable to the corners of the spreader bar. The loops may be formed from fastening means 75, such as hook and loop fastening means. More than just corner fastening means 75 may be provided to secure the spreader bar within the pocket 70. Optionally, the dimensions of the pocket 70 are sized to house a spreader bar with substantially the same dimensions. In this way any attachment means within the pocket 70 may be optional.

Figure 11:
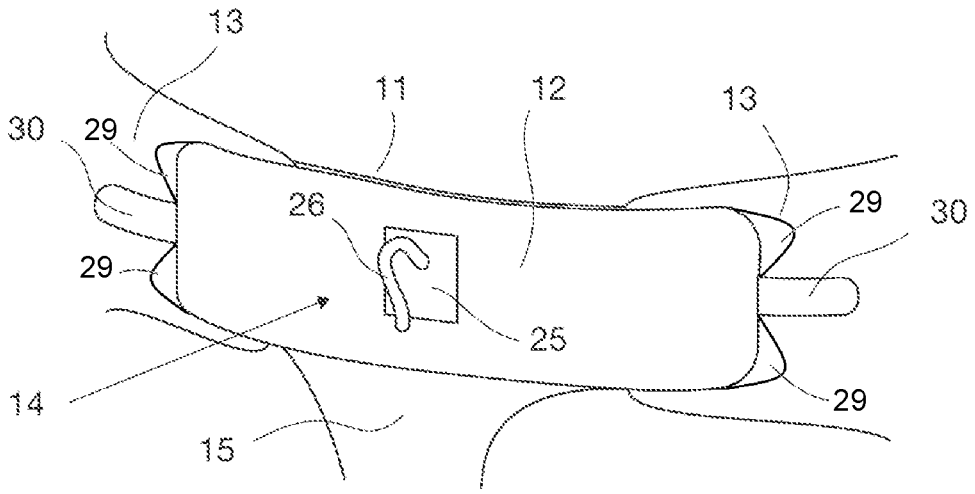
FIG. 11 illustrates an embodiment of an extended securing means disposed on the distal portion of the assembly.

Referring to FIG. 11, there is illustrated another embodiment of the assembly 14. The assembly 14 further comprising projection tabs disposed on the distal flaps 12. The projection tabs 29 may be formed integrally with the mating means and can be mated with the corresponding securing means on the side flaps 13. In this way, the distal flaps 12 can be mated with the side flaps 13 more securely with reduced lift of the distal flaps 12 during use. Further, the projection tabs 29 may also reduce the potential for accidental lifting of the distal flaps 12 during use. The projection tabs as shown are generally triangular in shape, however any desired projection tab shape may be used. Optionally, the release strap 30 may be positioned between the projection tabs of the assembly 14 as is shown.

In another embodiment, there may be provided an improved trapeze harness 1 or other hiking harness 1 with a waist adjustment including a front spreader bar assembly 14 comprising front piece 11 and distal flap 12 which may connect to side flaps 13 on each side of the harness body 10. Said front piece, distal flaps 12 and side flaps 13 may join via hook and loop fasteners to create a two-way adjustable system with the ability to adjust both the horizontal and vertical positioning of spreader bar assembly relative to the harness body. The harness 1 also features a groin piece 15 that connects harness body 10 to front spreader bar assembly 14 as well as padded shoulder straps 22 which also connect to the spreader bar assembly 14 via adjustment strap 24.

A fastening system 2 may be configured such that the area of hook and loop fastener coverage is large enough to hold the forces of the harness 1 such that the side flaps 13 will not become unattached while also allowing the flaps to be overlapped in such a way as to adjust the vertical position of the spreader bar assembly 14 as well as the circumference of the waist. It is also possible to twist the side flaps 13 slightly to tighten the bottom leg region more than the top waist line region, as another example of the variety in adjustments possible. Further, this may be used to improve the comfort of a user as portions of the fastening system 2 can be configured to conform more to a user anatomy.

The fastening system may allow a range of custom adjustable positions for different body types. This adjustable design of the harness may allow the harness 1 to fit better and become more responsive to body movement while sailing, while also providing improved muscular support, comfort, dexterity and responsiveness to the dynamics of the boat or sailboard.

The adjustable design may provide for a harness 1 that can be manufactured in standard sizes, such as small, medium and large, and better custom fit the user than known systems using strapping, and all the while may provide a more uniform and adjustable load bearing harness to the body.

In one embodiment, the harness features shoulder straps 22 which connect to the spreader bar assembly 14 via adjustment strap 24. Adjustment strap 24 preferably passes through the spreader bar assembly 14 and connects to the shoulder straps 22 at each end. Alternatively, the adjustment strap 24 forms a Y-shape from each shoulder strap 22 when connecting to the spreader bar assembly 14 as seen in FIG. 2. Adjustment strap 24 preferably features at least one buckle 23 that allows for adjustment in length and can optionally allow detachment of the straps for easy donning and doffing of the harness.

The harness 1 is preferably be constructed of composite materials that are configured to provide stiffness in some areas and flexibility in other areas. In another embodiment, the harness 1 is constructed from a closed cell foam and textile composite material that is highly air permeable, lightweight and fast draining whereby the textile is a circular or warp knitted mesh and the closed cell foam features perforations. Optionally, areas of the harness 1 may be reinforced through the use of woven textiles in load bearing areas and/or highly abrasion resistant textiles in high wearing zones, such as near to the groin region 15 or the lower back area or the seat area of the harness 1. In some embodiments, a pad 21 may be positioned in the lumbar region of the back for additional support.

In yet another embodiment the groin area 15 may be formed using a highly elastic textile preferably constructed into a cup shape which may support the groin area of a wearer comfortably. The reinforcing may be a high strength textile webbing 16 is provided on each side of the groin area 15 and around the body 10 of the harness 1 to distribute loads from the spreader bar assembly 14 through to the body 10 of the harness 1. When loads are applied to the harness 1; a soft and flexible inner material may reduce pressure on the groin area 15 thereby significantly improving the comfort of user wearing the harness 1. Optionally, additional soft material or padding is sewn to the underside of the webbing to reduce pressure on the sides of the groin area 15.

In a further embodiment there may be provided a spreader bar assembly 14 comprising a spreader bar 25 with hook or other trapeze attachment means 26. The spreader bar assembly 14 comprises the front piece 11 and distal flap 12 with a mating means, such as a hook fastener, covering the surface of the front piece 11 facing the over flap and another hook fastener covering the surface of the over flap facing the front piece. The side flaps 13 of the harness body may have a loop fastener covering both front and rear surface which can be inserted between the front piece 11 and distal flaps 12 which are closed to form an improved hook and loop fastened assembly connecting the spreader bar assembly to the harness body around the waist of the user.

The spreader bar 25 is fixed within the spreader bar assembly 14 such that loads can be spread via the assembly 14 during the acts of hiking or trapezing with the harness 1. The spreader bar 25 is preferably positioned within or connected to the front piece 11. The spreader bar 25 preferably has a covering or padding on the inside of the pocket 70 or on the proximal side 2' of the spread bar assembly 14 such that the user is insulated from direct contact with the spreader bar 25. The covering or padding may be a closed cell foam layer.

There are a variety of spreader bars 25 available commercially that can be used in the present invention. The spreader bar 25 is preferably curved to the body shape and is configured to the correct length in accordance to the size range of the harness 1. The spreader bar 25 may be produced from stainless steel, steel, aluminium alloy, carbon fibre or fibreglass composite or other material or combinations therein. In the application where the sailor is trapezing from a sailing dinghy the spreader bar preferably features a hook however other means of attachment to the trapeze line as known in the art may also be provided to suit various preferences and applications.

A quick release mechanism (quick release system 3) is preferably provided on the adjustable fastening system 2 comprising one or more release straps 30 that facilitate easy disengagement of the mating means, which may be hook and loop fasteners, that connect the front piece 11, distal flaps 12 and side flaps 13 by lifting the adjoining mating means surfaces away from each other in a single motion.

A release strap 30 may be attached at one end to the outer edge of side flap 13 on each side of the harness 1. The release strap 30 is positioned between the distal flap mating means 32 (which may be a hook/loop fastener 32) on distal flaps 12 and distal side flap mating means (which may be a loop/loop fastener 33) on side flap 13 and protrudes from the fastening system 2 to allow the user to grip and pull the strap. To release the fastening system 2, the user pulls the release strap 30 away from the harness body 10 thereby separating the distal flap mating means 32 on distal flaps 12 from the loop fastener 33 on side flap, as the user continues to pull the release strap 30 the side flap 13 is then pulled away from front piece 11, separating proximal side flap mating means 34 (which may be loop fastener 34) on side flap 13 from front piece mating means 31 (which may be a hook fastener 31) on front piece 11.

In another embodiment, the release strap 30 may be attached at one end to the outer edge of front piece flap 11 on each side of the harness 1. The release strap 30 is positioned between the front piece mating means 31 on distal flaps 12 and distal side flap mating means 33 (which may be a loop fastener 33) on side flap 13, the release strap 30 can then be folded around side flap 13 and positioned between the front piece mating means 31 on distal flaps 12 and distal side flap mating means 33 on side flap 13. The strap protrudes from the fastening system 2 to allow the user to grip the release strap 30. To release the fastening system 2, the user pulls the release strap 30 away from the harness body 10 thereby separating the front piece mating means 31 on distal flaps 12 from the distal side flap mating means 33 on side flap 13, as the user continues to pull the release strap 30 the proximal side flap mating means on side flap 13 is separated from front piece mating means 31 on front piece 11.

The release strap 30 may be comprised of a knitted or woven textile, rubber, leather, polymer or other material or combination thereof and should have adequate flexibility to allow the release strap 30 to confirm the to shape of the spreader bar assembly 14. The release strap 30 a woven strap which may be formed with synthetic yarns such as polyester, nylon or polypropylene. Preferably, the release strap 30 has high resistance to snagging against the mating means, which may be hook fasteners, in order to prevent damage during use and also to allow the release strap 30 to separate easily from the mating surfaces. The thickness of the release strap 30 is preferably minimised to allow for easy adhesion between the mating surfaces and is preferably 4 mm thick or less (between 1 mm to 4 mm). Other thicknesses may be used depending on the desired end user and the application of the harness 1. The shape of the strap 30 is configured so that the width of said strap 30 is adequate to provide enough tensile strength to enable the fastening surfaces to be separated but narrow enough to maintain adequate contact between the fastening for normal operation of the harness. As such, the release strap 30 may be between 5 mm to 30 mm in width depending on the desired strap 30 material. In another embodiment strap 30 comprises hook and/or loop fasteners on the surface adjacent to the side flap 13 when in the closed configuration. This may allow for easy positioning of the release strap 30 when donning the harness and assist with mating of the side flap 13 with the distal flaps 12. The strap 30 may also feature a looped end or other gripping means to allow for easy release of the system 2.

In alternative embodiments, the if the mating means are hook and loop fasteners, the hook and loop fasteners may be alternated to so that the loop fasteners are positioned on the front piece 11 and distal flaps and the hook fasteners are positioned on the side flaps 13. However, it will be appreciated that self-engaging fasteners may be used, such that regardless of the position they may be mated. For example, ALFA-LOK™ fasteners may be used or a similar self-engaging fastener.

In yet another embodiment, an interchangeable system is provided to allow the spreader bar 25 to be easily removed and interchanged by the user to allow for repair and/or use of different configurations of spreader bar 25 to suit requirements. Preferably the spreader bar 25 is attached to the front piece 11 of the spreader bar assembly 14 by mating means such as hook and loop fasteners, press studs or any other desired mating means. Optionally, front piece 11 comprises two layers such that the spreader bar 25 is enclosed between these layers. An opening 76 is provided to allow insertion and removal of the spreader bar 26. This opening 76 is preferably closed by a zipper (zip), hook and loop fastener or other fastener. The spreader bar 25 is fixed within the spreader bar assembly 14 such that it is stiff and can spread the loads during the acts of hiking or trapezing with the harness. The spreader bar 25 is preferably positioned within or connected to the front piece 11. The spreader bar 25 preferably has a covering on the inside such that the body is insulated from direct contact with the spreader bar 25, preferably using a closed cell foam layer.

The spreader bar assembly 14 comprises said front piece 11 and over flap 12 with hook and loop fastening system. A removeable and interchangeable spreader bar 25 is positioned on the inner side of front piece 11 with the hook or other trapeze line attachment protruding or accessible to the front of the harness through hole 71. The spreader bar 25 is attached to the front piece 11 by one or more fastening attachments 75 which are fixed to front piece 11. Several fastening attachments may be provided in various locations for fitment of different sizes and shapes of spreader bars. Fastening attachments may be comprised of hook and loop fasteners, press studs or any other fastening means. An optional covering panel 72 covers the inner face of front piece 11 and spreader bar 25. The covering panel can be fixed to front piece 11 and access to the spreader by provided by means of an opening 74 with a zipper, hook and loop fastener or other fastening means and preferably also includes a pad panel that is positioned between the spreader bar and the user to prevent discomfort caused by the rigid spreader bar against the user's body. Said pad may be formed from a closed cell foam such as neoprene or EVA foam between 2-5 mm thickness. The spreader bar assembly 14 also features a shoulder strap attachment point 27 which is preferably provided at the centre top of the spreader bar 25 but may also be fixed to the front piece and/or over flap 12. If the shoulder strap attachment point 27 is provided on the spreader bar 25 an aperture 76 is formed between front piece 11 and covering panel 72 is provided for the shoulder adjustment strap 24 as shown in FIG. 7C.

In another embodiment, the spreader bar attachment means comprises a locating block 80 may be provided on either side of the front piece in addition to fastening attachments 81. The locating block 80 preferably features multiple grooves in which the spreader bar 25 fits within and is secured by fastening attachments 81. The multiple grooves of the locating block allow different sized spreader bars to be used and also facilitate a secure and rigid attachment to the front piece 11. Said locating blocks are preferably made from an extruded or moulded polymer such as polyurethane, polyester, nylon, polypropylene or other material. Said fastening attachments 81 may be comprised of hook and loop fasteners, press studs, elastic loops or another available fastener.

The harness system 10 may be used for small boat dinghy sailing and trapezing. Other uses for the harness may also be apparent for other sporting activities or uses. Further, the quick release system 3 of the harness 10 may also provide for a more efficient means for a user to take off a harness 1.

The harness 1 may provide for improved support relative to known harnesses, and may allow for improved dexterity of the wearer, may increase the sensitivity and/or responsiveness of the harness, and may provide for increased comfort. These improvements make the harness 1 particularly attractive for a trapezing in a small sailing dinghy or other water vessel.

Another use for the harness may be for yachting and droop hiking. In this example, the harness 1, may provide for a desired level of support, dexterity, sensitivity, responsiveness and comfort.

A further use for the harness 1 may be for sailboard harnesses. It will be appreciated that the sailboard harness may be required to be formed with a similar design in the styles for sailboarding, with hook and loop fastener adjustment means for an improved fit relative to the commercially available harnesses which may have multiple strapping which can cause discomfort during due and also undue pressure on the body of the wearer during use.

Although the invention has been described with reference to specific examples, it will be appreciated by those skilled in the art that the invention may be embodied in many other forms, in keeping with the broad principles and the spirit of the invention described herein.

The present invention and the described preferred embodiments specifically include at least one feature that is industrial applicable.

The invention claimed is:

1. A harness for sailing, the harness comprising;

a harness body with a pair of side flaps, a groin piece connected to the harness body and connecting to a spreader bar assembly;

the spreader bar assembly comprising a front piece, and a pair of distal flaps, in which a respective side flap can be positioned between the front piece and the respective distal flap to be releasably secured therein; and wherein the spreader bar assembly comprises a quick release strap positioned between each distal flap and respective side flap, such that when the quick release strap is moved distally of the spreader bar assembly, the distal flap is separated from the side flap.

2. The harness as claimed in claim 1, wherein moving the release strap further distally can separate the side flap from the spreader bar assembly.

3. The harness as claimed in claim 1, wherein the harness body further comprises a pair of straps.

4. The harness as claimed in claim 1, wherein the spreader bar assembly comprises a pocket in which a spreader bar is housed.

5. The harness as claimed in claim 1, wherein a hook projects distally of the spreader bar assembly.

6. The harness as claimed in claim 1, wherein the front piece, side flaps and distal flaps comprise hook and loop fasteners.

7. The harness as claimed in claim 1, wherein the release straps are fixed to the side flaps at a periphery.

8. The harness as claimed in claim 1, wherein the groin piece is formed with a graduated elasticity.

9. The harness as claimed in claim 1, wherein the harness body comprises a pad positioned in a lower region of the harness.

10. The harness as claimed in claim 1, wherein the quick release strap comprises a toggle at a free end.

11. A harness for sailing, the harness comprising;

a harness body having a pair of shoulder straps and a groin portion, the groin portion being fixed to a spreader bar assembly, the spreader bar assembly comprising a pocket formed from a front piece and a rear covering panel, the pocket being adapted to receive a spreader bar with a hook, in which the hook is adapted to be mounted through an aperture formed in the front piece, and wherein the spreader bar comprises an attachment point such that a shoulder strap can be mounted to the attachment point within the pocket, and an opening is formed at the top of the pocket to pass the shoulder strap into the pocket.

12. The harness as claimed in claim 11, wherein the harness body comprises a pair of side flaps.

13. The harness as claimed in claim 11, wherein a pair of distal flaps are mounted on the front piece of the spreader bar assembly.

14. The harness as claimed in claim 11, wherein a release strap is connected to the front piece.

15. The harness as claimed in claim 12, wherein a release strap is connected to the side flaps.

16. The harness as claimed in claim 11, wherein the groin portion has a graduated elasticity.

17. The harness as claimed in claim 11, wherein the rear covering panel comprises a pad.

18. The harness as claimed in claim 11, wherein the harness body comprise a reinforcing means.

19. The harness as claimed in claim 11, wherein the spreader bar is removable from the pocket.

20. The harness as claimed in claim 11, wherein the harness body further comprises a back portion with a pad positioned about a lumbar region of a wearer when in use.

* * * * *